United States Patent [19]

Kandatsu

[11] Patent Number: 4,864,261

[45] Date of Patent: Sep. 5, 1989

[54] CONTACTOR DEVICE FO CIRCUIT BREAKER

[75] Inventor: Kiyoshi Kandatsu, Kanagawa, Japan

[73] Assignee: Fuji Electric Co., Ltd., Kanagawa, Japan

[21] Appl. No.: 203,117

[22] Filed: Jun. 7, 1988

[30] Foreign Application Priority Data

Jun. 10, 1987 [JP] Japan ..... 62-144545

[51] Int. Cl.[4] ..... H01H 75/00

[52] U.S. Cl. ..... 335/16; 335/147; 335/195

[58] Field of Search ..... 335/16, 147, 195; 200/147 R

[56] References Cited

U.S. PATENT DOCUMENTS 4,219,790 8/1980 Batteux et al. ..... 335/16

4,635,012 1/1987 Kohanawa et al. ..... 335/16

*Primary Examiner*—E. A. Goldberg

*Assistant Examiner*—Lincoln Donovan

*Attorney, Agent, or Firm*—Finnegan, Henderson, Farabow, Garrett and Dunner

[57] ABSTRACT

A contactor device of a circuit breaker has a movable contactor to be raised or opened upon the occurrence of a short circuit current. One end portion of the movable contactor is bifurcated to form parallel claw members that engage a rotatable trip latch. When the movable contactor is raised due to a magnetic repelling force generated in the movable contactor and a fixed contactor during a short-circuit condition, the claw portions of the movable contactor are deformed due to a magnetic attractive force and are disengaged from the trip latch. The rotation of the movable contactor is restricted and it returns to the original positional relationship in which the claw members are engaged with the trip latch.

8 Claims, 3 Drawing Sheets

CONTACTOR DEVICE FO CIRCUIT BREAKER

FIELD OF THE INVENTION

This invention relates to a contactor device employed in a circuit breaker and more particularly to a contactor device or mechanism of the current-limiting type having a fixed contactor and a movable contactor which are instantaneously separated due to a magnetic repelling force generated between the fixed and movable contactors.

BACKGROUND OF THE INVENTION

A conventional and well known contactor device is shown in the closed condition in FIG. 6 and in the open condition in FIG. 7. As shown in FIGS. 6 and 7, the conventional contactor device consists of a U-shaped fixed contactor 2 provided with an upper leg portion having a fixed contact point 1 provided thereon with solder or the like, a movable contact point 3 and at its other end with a U-shaped indent 4*a*. The movable contact point 3 is adapted to come in contact with the fixed contact point 1 and the movable contactor 4 extends in parallel with the upper leg portion of the fixed contactor 2 when the contactor device is closed. A dielectric holder 5 is oscillatably supported and supports in a rotatably journalled manner the other end of the movable contactor 4. A contacting or compression spring 7 is installed between the dielectric holder 5 and the indent 4*a* of the movable contactor 4 through a pin 6 to provide the force in the direction shown by an arrow in FIG. 6. This force produces counterclockwise moment around the journal of the movable contactor 4 to give contact pressure between the fixed contact point 1 and the movable contact point 3. An elastic conduit 8 is connected to the movable contactor 4.

A current breaking operation in response to a short-circuit is carried out in the conventional contactor device as follows. When the contactor device is in its closed condition and a high current in the short-circuit range flows through the fixed contactor 2 and the movable contactor 4 as shown in FIG. 6, the high current generates a magnetic repelling force F1. This causes the movable contactor 4 to rotate clockwise and the indent 4*a* to displace. Consequently, the point of application of the force of the compression spring 7 is shifted as shown in FIG. 7 to accelerate the clockwise rotation, and the fixed contact point 1 and the movable contact point 3 are instantaneously separated in order to open the contactor device as shown in FIG. 7.

However, in a closing motion of the conventional contactor device, the movable contact point 3 strikes or collides with the fixed contact point 1 as the movable contactor 4 and the fixed contactor 2 are instantaneously closed. This generates a shocking force and causes the compression spring 7 to vibrate. As a result, the point of application by pin 6 may be shifted for an instant to its former position, the open condition, and causes the clockwise rotation of the movable contactor 4, which results in an instantaneous separation of the movable contactor 4 from the fixed contactor 1. This causes undesirable open-phase condition. In order to prevent the contactor device from instantaneously separating, it is necessary to determine accurately the force of the compression spring 7 in view of the strength of the shocking force which will be generated.

When high shocking force is generated in a closing motion of the conventional contactor device, the contact pressure provided by the movable contactor 4 must be kept higher than the shocking force by increasing the force of the compression spring 7, and the magnetic repelling force F1 is required to be furthermore longer than this increased contact pressure. This causes the current-limiting start current value to be disadvantageously high. Consequently, it has been difficult to manufacture economically a small-sized circuit breaker provided with an excellent current-limiting characteristic.

SUMMARY OF THE INVENTION

It is an object of the present invention to overcome the disadvantages of prior art contactors of small-sized circuit breakers.

Another object of the present invention is a contactor device of a small circuit breaker which is able to determine freely the current value for starting a current-limiting operation without regard to the shocking force to be generated during a closing of the circuit breaker.

Still a further object of the present invention is a contactor of a circuit breaker that operates in an accurate and safe manner.

These and other objects are achieved by a contactor device for a circuit breaker comprising a first contactor having a first contact point, a holder, a movable contactor having a first end and a second end, the second end being bifurcated to form a first claw member and a second claw member parallel to the first claw member, the first and second claw members being rotatably mounted on the holder such that the movable contactor is rotatable between a closed contact position and an open contact position, trip latch means for supporting the first and second claw members to maintain the movable contactor in the closed contact position when the contactor device is not subject to a short circuit current, and a second contact point on the first end of the movable contactor for contacting the first contact point to enable electrical current to flow between the first contactor and the movable contactor, the current flowing through the first contactor and the first claw member and the second claw member establishing a first magnetic field between the first claw member and the second claw member and a second magnetic field between the first contactor and the movable contactor, the first magnetic field causing the first and second claw members to be deformed in response to a short circuit current o disengage the first and second claw members from the trip latch means and the second magnetic field for repelling the movable contactor from the first contactor in response to a short circuit current to rotate the movable contactor to the open contact position.

BRIEF DESCRIPTION OF THE DRAWINGS

The manner by which the above objects and other objects, features, and advantages of the present invention are attained will be fully apparent from the following description when considered with reference to the accompanying drawings in which.

DETAILED DESCRIPTION OF THE PREFERRED EMBODIMENTS

Figure 1:
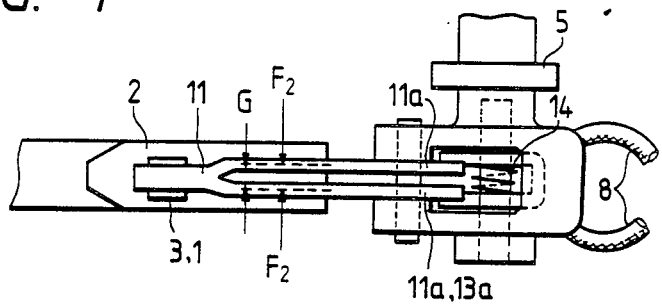
FIG. 1 is a plan view of an embodiment of the circuit breaker constructed in accordance with the present invention.
Figure 2:
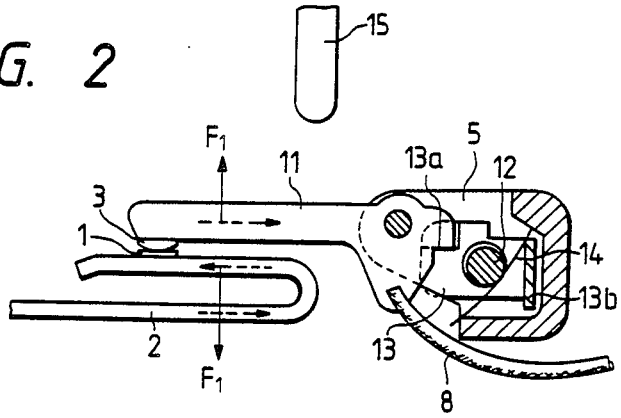
FIG. 2 is a sectional elevational view of the contactor device of the circuit breaker of FIG. 1, when the breaker is closed.

The contactor device of a circuit breaker of the present invention has a fixed, U-shaped contactor that provides a fixed contact point secured to a leg portion of the U-shaped structure. A movable contactor has a first end at which a movable contact point is secured to contact and be supported from the fixed contact point on the fixed contactor. The other end of the movable contactor is forked-shaped and confronts the fixed contactor when the contactor device is closed. The movable contactor is made of resilient electrically conductive material. A dielectric holder supports the movable contactor in a rotatably journalled manner and a trip latch that is engaged with claws on the forked-shaped end of the movable contactor is oscillatably journalled. A contacting or compression spring is installed between the dielectric holder and the trip latch in order to apply a contacting pressure to the movable contactor, and a stopper is adapted to contact the movable contactor when the contactor is disengaged from the trip latch and is rotated clockwise around its other end in order to make the trip latch engage repeatedly with the claws.

The movable contactor of the circuit breaker, which is parallel with the U-shaped fixed contactor, has an end bifurcated to form parallel claws, and engagement between the claws and the trip latch is terminated when a magnetic attractive force is generated between the two claws as a result of current flowing in the same direction through the claws causes the gap between the claws to decrease. The direction of the magnetic attractive force for disengagment differs by 90 degrees (or a right angle) from that of the shocking force applied to the movable contactor during closing of the circuit breaker. The applying direction of the shocking force is separate from the direction of the magnetic attractive force. As a result, the current for starting the current-limiting function can be determined without regard to the force of the closing shock applied to the movable contactor.

Referring now to the drawings, like reference characters designate like or corresponding parts throughout the several views.

Figure 6:
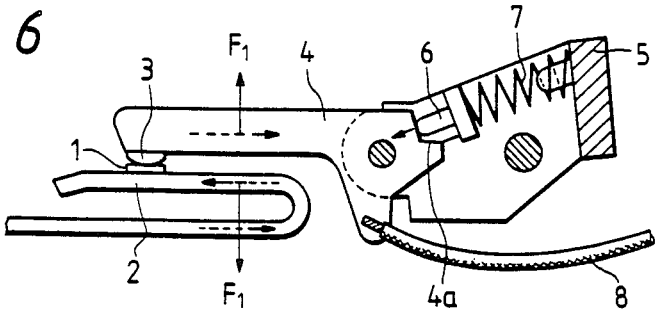
FIG. 6 is a sectional elevation of one example of a contactor device of a conventional circuit breaker in its closed condition.
Figure 7:
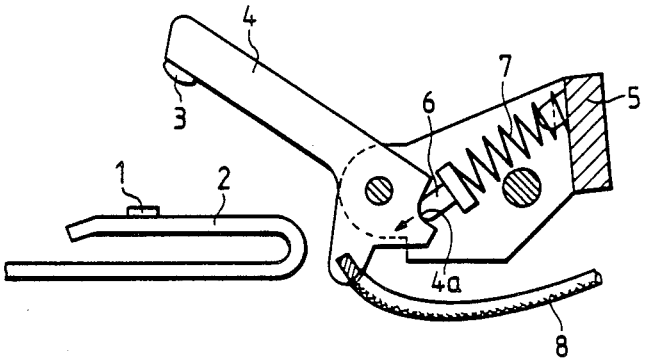
FIG. 7 is view of the contactor device of FIG. 6 in its open condition.

An important difference between the preferred embodiment of the invention and the prior art contactor device of the circuit breaker shown in FIGS. 6 and 7 resides in the novel construction in which an engagement force is sufficient to resist the shocking force generated in the circuit breaker when the movable contactor is closed. Moreover, contrary to the prior art, in the present contactor device there is no relation between the engagement force and the contact pressure of a movable contact point onto a fixed contact point. In order to attain the effectiveness mentioned above, the movable contactor 11 of the circuit breaker extends along the same direction as the bending of the fixed contactor 2. The base of the movable contactor 11 is bifurcated along its axial direction to form two parallel claws separated by a gap G. The two claws 11*a* are made of a conductive, resilient or elastic material.

The dielectric holder 5, which rotatably holds the movable contactor 11 as described above, has a supporting shaft 12. A trip latch 13 is journalled on the supporting shaft 12 and has U-shaped portions which have stepped portions 13*a*.

The edges of the ends of the claws 11*a* are engaged with the sides of the stepped portions 13*a* of the trip latch 13. A contact or coil spring 14 is provided around the supporting shaft 12. The contact spring 14 is adapted to apply a contacting force to the movable contactor 11 when the claws 11*a* of the movable contactor 11 engage with and press against the stepped portions 13*a* of the trip latch 13.

The claws 11*a* of the fork-shaped end portion of the movable contactor 11 are elastically deformed to change the distance of the gap G owing to the magnetic attractive force F2 generated by currents flowing in the claws 11*a* in the short circuit range previously determined. In the preferred embodiment, the narrowing of the gap G causes the claws 11*a* of the movable contactor 11 to disengage from the stepped portions 13*a* of the trip latch 13. A stopper 15 that restricts the raising height or degree of rotation of the movable contactor 11 is provided on a cover (not shown) of the circuit breaker.

Figure 3:
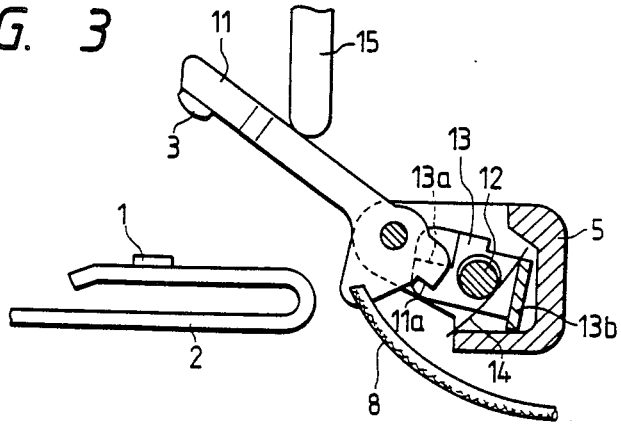
FIG. 3 is a sectional elevational view of the contactor device of the circuit breaker of FIG. 1, when the breaker is open.

In operation, when a large current in a short-circuit range flows through the closed contactor device of the invention, a current-limiting function is applied to the large current which flows from the fixed contactor 2 and the movable contactor 11 to claw portion 11*a*. Because the current flows through the claws 11*a* in the same direction, magnetic attractive force is generated (as shown in FIG. 1 by arrows F2) to elastically deform the claws This results in the disengagement of the claws 11*a* from the stepped portions 13*a*. A magnetic repelling force generated by the current flowing through the fixed contactor 2 and the movable contactor 11 opens or raises the movable contactor 11 until it collides with the stopper 15 at an intermediate portion of the movable contactor 11 as shown in FIG. 3.

The trip latch 13, which has been disengaged from the claws 11*a*, is rotated clockwise by the force of the contact spring 14 and stops in a stable position when a limiter 13*b* abuts the dielectric holder 5.

Figure 4:
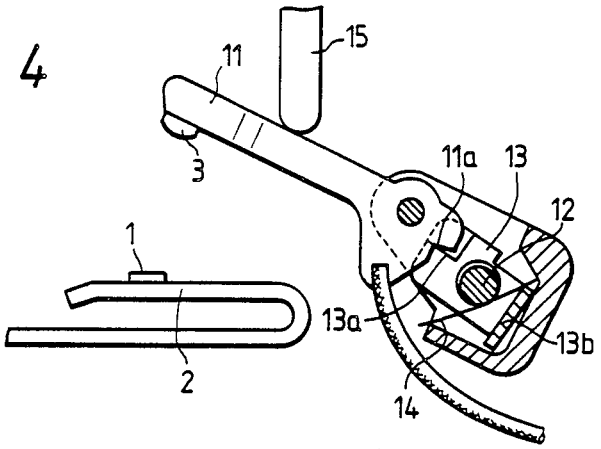
FIG. 4 is a sectional elevational view of the contactor device of the circuit breaker of FIG. 1 showing a re-engagement condition of the movable contactor and the trip latch.

In order to make the claws 11*a* return to their original positions in engagement with the stepped portions 13*a* of the trip latch 13, a suitable tool (not shown) is used to rotate the dielectric holder 5 clockwise to the position of FIG. 4 and the overlapped relation of the claws 11*a* of the movable contactor 11 and the trip latch 13 is eliminated because the rising motion (further rotation) of the free end of the movable contactor 11 is restricted by the stopper 15.

Figure 5:
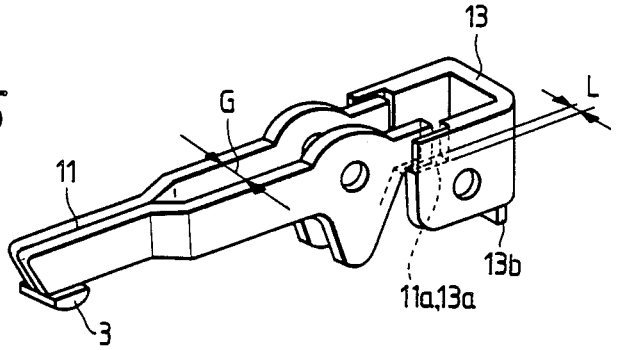
FIG. 5 is a perspective view of the movable contactor and the trip latch in the engaged position.

The level of the current for generating a magnetic attractive force necessary to make the claws 11*a* of the movable contactor 11 disengage from the stepped portions 13*a* of the trip latch 13 or for limiting the current can be freely determined by suitably selecting the distance of the gap G of the claws 11*a* of the movable contactor 11 and the thickness or width L of the stepped portions 13*a* as shown in FIG. 5. When the distance of the gap G and the thickness of the stepped portions 13*a* are decreased, the current-limiting current will be smaller. On the contrary, if they are made larger than the current level will be higher.

In accordance with the present invention, an effective contactor device suitable to be employed in a circuit breaker can be provided in which the shocking force of the movable contactors generated when the circuit breaker is closed does not influence the level of current selected for starting a current-limiting function. It is possible to cause current to flow through the claws of the movable contactor along the same direction as shown and to use the magnetic attractive force which is different from the shocking force by 90 degrees or a right angle in their application directions in order to trip the contactor. As described above, the contactor device has an excellent current-limiting feature and may be manufactured at a low cost and with a small size.

Although only one embodiment of the invention has been disclosed and described, it is apparent that other embodiments and modifications of the invention are included within the scope of the appended claims.

What is claimed is:

1. A contactor device for a circuit breaker comprising:

a first contactor having a first contact point;

a holder;

a movable contactor having a first end and a second end, said second end being bifurcated to form a first claw member and a second claw member parallel to said first claw member, said first and second claw members being rotatably mounted on said holder such that said movable contactor is rotatable between a closed contact position and an open contact position;

trip latch means for supporting said first and second claw members to maintain said movable contactor in said closed contact position when the contactor device is not subject to a short circuit current; and a second contact point on said first end of said movable contactor for contacting said first contact point to enable electrical current to flow between said first contactor and said movable contactor, said current flowing through said first contactor and said first claw member and said second claw member establishing a first magnetic field between said first claw member and said second claw member and a second magnetic field between said first contactor and said movable contactor, said first magnetic field causing said first and second claw members to be deformed in response to a short circuit current to disengage said first and second claw members from said trip latch means and said second magnetic field for repelling said movable contactor from said first contactor in response to a short circuit current to rotate said movable contactor to said open contact position.

2. A contactor device according to claim 1, wherein said first and second claw members are separated by a first predetermined distance when no short circuit current exists and wherein said trip latch means comprises:

a first claw support member for supporting said first claw member; and a second claw support member for supporting said second claw member, said first and second claw support members being separated by second predetermined distance, said first and said claw members being magnetically attracted to each other upon the occurrence of a short circuit current such that said first and second claw members become separated by a distance less than said first predetermined distance and their external dimension is decreased to be less than said second predetermined distance, and said first and second claw members are no longer supported by said first and second claw support members.

3. A contactor device according to claim 2, wherein said first and second claw members are formed from resilient, conductive material.

4. A contactor device according to claim 1, wherein said trip latch means is supported on said holder for rotation between a normal current position and a short circuit position and wherein said contactor device further includes spring means for urging said trip latch means to rotate from said normal current position to said short circuit position upon the disengagement of said first and second claw members from said trip latch means in response to the short circuit condition.

5. A contactor device according to claim 1, wherein said first contactor is substantially U-shaped.

6. A contactor device according to claim 1, further including a stopper for limiting the rotation of said movable contactor when said movable contactor rotates from said closed contact position to said open contact position in response to a short circuit current.

7. A contactor device according to claim 1, wherein said holder is made from a dielectric material.

8. A contactor device according to claim 1, wherein said first and second claw members are returned to original positions thereof in engagement with said trip latch means by the rotation of said holder.

* * * * *